United States Patent [19]

Ramsey et al.

[11] 3,988,130

[45] Oct. 26, 1976

[54] ELECTROSTATIC PRECIPITATOR WITH RAPPER AND PNEUMATIC FLOW BLOCKING

[75] Inventors: James R. Ramsey; Terence D. Baier, both of La Crosse, Wis.; William B. Swim, Cookeville, Tenn.

[73] Assignee: The Trane Company, La Crosse, Wis.

[22] Filed: Sept. 24, 1975

[21] Appl. No.: 616,273

[52] U.S. Cl. ..... 55/112; 55/120; 55/139; 55/151; 55/154; 55/273; 55/302

[51] Int. Cl.[2] ..... B03C 3/76

[58] Field of Search ..... 55/13, 12, 112, 120, 55/139, 273, 117, 152, 151, 154, 302

[56] References Cited

UNITED STATES PATENTS

| | | | |
|---|---|---|---|
| 1,399,441 | 12/1921 | Peterson | 55/117 |
| 1,800,529 | 4/1931 | Horne | 55/12 |
| 2,712,362 | 7/1955 | Winkelpeck | 55/120 |
| 2,804,168 | 8/1957 | Church | 55/302 |
| 2,874,802 | 2/1959 | Gustafsson | 55/151 |
| 3,109,720 | 11/1963 | Cummins et al. | 55/13 |

FOREIGN PATENTS OR APPLICATIONS

| | | | |
|---|---|---|---|
| 243,343 | 2/1963 | Australia | 55/150 |

*Primary Examiner*—Bernard Nozick

[57] ABSTRACT

An electrostatic precipitator is disclosed which is provided with a plurality of gas jets which upon activation repulses the normal gas flow through the electrostatic precipitator during cleaning to create a quiescent condition to reduce further dispersion of the loosened particulate layer into the outlet stream. A control system for operating the jets and the discharge and collector plate rappers is shown.

20 Claims, 15 Drawing Figures

FIG. 3

ELECTROSTATIC PRECIPITATOR WITH RAPPER AND PNEUMATIC FLOW BLOCKING

BACKGROUND OF THE INVENTION

The removal of solid particles such as dust suspended in a primary gaseous stream by means of electrostatic precipitation is a well-known art. A high electrical potential is established across two spaced electrodes between which the dust-laden gas flows. A corona discharge is established at the emitter electrode due to the voltage gradient which produces an ion cloud that brings about a surface attachment of ions to the solid particles suspended in the primary gas.

By virtue of the electrostatic field extending between the electrodes, the charged solid particles are attracted toward the collector electrode surface. If the particles are of low resistivity they may become neutralized upon contacting the collector electrode. Despite this neutralization the particles tend to be retained on the collector surface by virtue of other forces such as cohesion and adhesion as well as induced electrostatic forces due to the incoming ion shower.

Modern industrial precipitators take several different forms. The parallel flat plate collector electrodes with multiple wire emitters or discharge electrodes are common. In another design the emitter wires are replaced by an open grid. Special designs may employ a circular collector tube with an axial wire emitter. In all electrostatic precipitators there exists the problem of cleaning the particulate layer from the collector surface.

It has now become cnventional to clean the solid particulate layer from the collector plate electrodes by means of vibrationally rapping or jarring the collector surfaces. The detached layer, in a more or less agglomerated sense, falls to the hoppers or bins below. In falling along side of the collector electrode surface the fractured layer tends to further break up and disperse. Most of the dust falls to the hoppers below, but a significant portion of this dispersed material becomes reentrained in the primary gas flowing through the electrostatic precipitator and is thus discharged at the outlet. To minimize this effect it is common to place multiple collector electrode assemblies in series along the flow path to cope with the particulate reentrainment problem. As a result, electrostatic precipitator devices have become physically very large.

SUMMARY OF THE INVENTION

This invention pertains to electrostatic precipitators and particularly to a means of cleaning electrostatic collector plate electrodes. The concept involved is one in which a jet of secondary gas is directed at the stream of primary gas in such a manner as to stagnate the flow of the primary stream in the vicinity of the collector plate electrodes being cleaned. It utilizes the inertia or momentum of a secondary stream of gas to stop or reduce the flow of primary gas so that the particulate layer, when loosensed by jarring such as by vibratory rapping or by other means, may fall into the hoppers through a more or less quiescent zone to minimize further dispersion of the fragmented layer of particulate. It will be apparent that the operating effect of these jets of secondary gas is opposite so that achieved in some prior art devices by jets of gas or liquid directed to produce great turbulence at the collector electrode surface for loosening the particulate layer.

It is thus an object of this invention to provide an electrostatic precipitator with means for creating a quiescent zone within the collector to permit the particulate layer to be removed from the collector region with a minimum of particulate dispersion into the stream of primary gas flowing from the precipitator outlet.

It is a further object of this invention to arrest the flow of primary gas in at least a portion of an electrostatic precipitator to permit the particulate layer to be removed from that collector portion with a minimum of particulate dispersion into the stream of primary gas flowing from the precipitator outlet.

It is still a further object of this invention to provide in an electrostatic precipitator a means of penumatically isolating a portion of the collector section from the outlet flow stream by the use of jets of secondary gas positioned to impede the flow of primary gas through the portion of an electrostatic precipitator being cleaned.

It is another object of this invention to position such flow impeding jets so as to minimize fluid turbulence in the vicinity of the collector electrodes being cleaned so that the particulate layer being removed is not widely dispersed into the outlet stream of the precipitator.

And it is still another object of our invention to provide a means of reducing the size of an electrostatic precipitator through increased efficiencies in collector electrode cleaning.

Specifically this invention involves an electrostatic precipitator apparatus for removing particles from a primary gas containing particles comprising: a plurality of pairs of spaced substantially impervious particle collector plate electrodes; means for imparting an electrostatic charge to said particles relative to said electrodes; means for passing streams of said primary gas containing particles into the spaces between said pairs of said electrodes from an upstream end toward a downstream end whereby the charge particles are attracted by and precipitated on said electrodes; means for jarring each of said electrodes for removing particles therefrom; pneumatic flow repulsing means disposed adjacent said upstream end of said electrodes and spaces for directing a stream of secondary gas in a direction having a predominant component opposing the flow of said primary gas and particles into the spaces to thereby substantially arrest the flow of said primary gas and particles into the spaces; and means for intermittently operating sid jarring means associated with at least one of said electrodes but less than all of said electrodes and simultaneously operating said pneumatic flow repulsing means associated with at least one of said spaces adjacent said one electrode whereby a substantially quiescent condition within said space is produced by said secondary gas during removal of said particles from said one electrode by said jarring means to thereby reduce further particle dispersion within said space and reentrainment of said removed particles in said primary gas at said downstream end of said space.

Additional objects and advantages will become apparent as this specification describes the invention with reference to the drawings wherein like numerals have been used to designate like elements throughout and in which.

DETAILED DESCRIPTION

Figure 2:
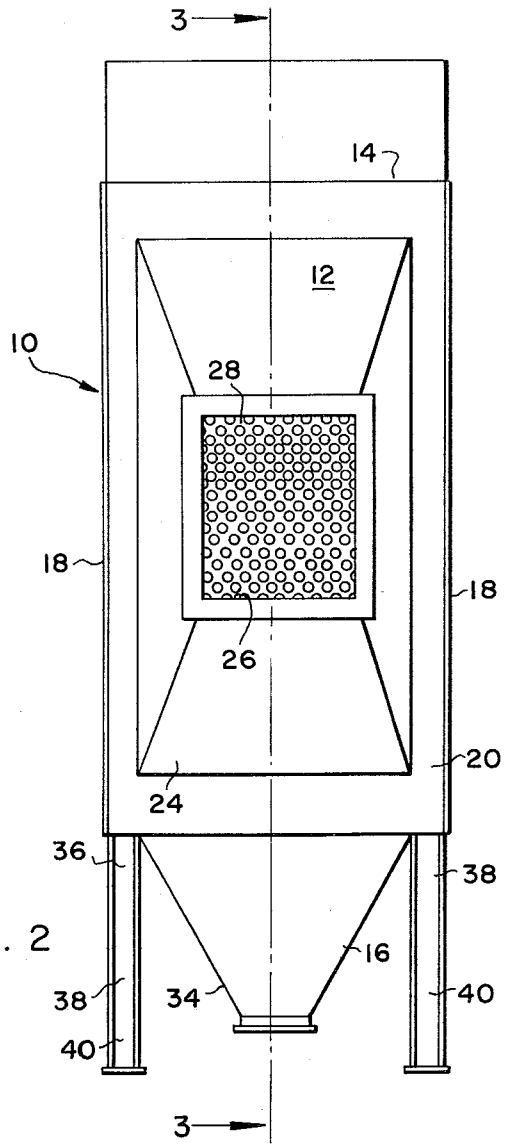
FIG. 2 is an end elevation of the precipitator of FIG. 1 viewing the inlet thereof.
Figure 1:
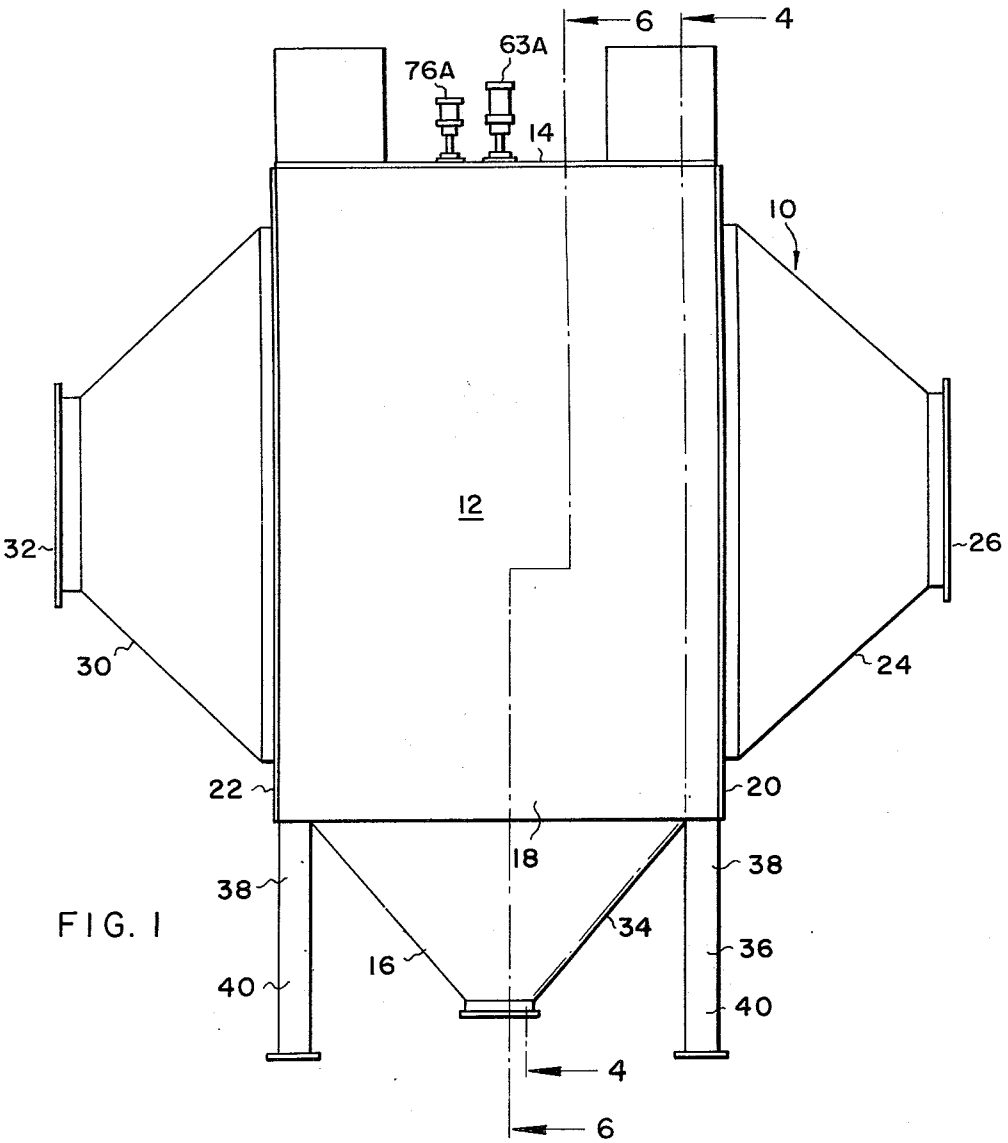
FIG. 1 is a side elevation of an electrostatic precipitator incorporating the invention.

Now referring to the drawings it will be seen that our electrostatic precipitator apparatus 10 includes a main housing 12 containing an electrode system 13. The main housing functions to pass a primary gas containing particles over the electrodes therein.

Main housing 12 has a top wall 14, a bottom wall 16, a pair of side walls 18, and inlet end wall 20, and an outlet end wall 22. Inlet end wall 20 has an enlarging transition section 24 extending from a relatively small inlet opening 26 substantially to the upstream face of an electrode system 13. A perforated diffuser plate 28 is disposed at the inner end of transition section 24 to insure uniform distribution of gas to the electrode system 13. Outlet end wall 22 includes a constricting transition section 30 extending substantially from the downstream face of the electrode system 13 to a relatively small outlet opening 32. Bottom wall 16 includes a hopper 34 for collecting precipitated particles removed from the electrode system as hereinafter described.

The housing 12 is supported from a main frame 36 which includes a vertical H beam 38 disposed within each of the four corners joining the side and end walls 18, 20, and 22. The lower portions of beams 38 protrude outwardly of housing 13 to define external leg portions 40 upon which the precipitator apparatus 10 is supported. Main frame 36 includes upper horizontal longitudinal H beams 42 extending internally of housing 12 along the corners formed by the intersections of side walls 18 with top wall 14 and upper horizontal lateral H beams 44 extending internally of housing 12 along the corners formed by the intersections of end walls 20 and 22 with top wall 14. Similarly, lower horizontal longitudinal H beams 46 extend internally of housing 12 along the lower edge of side walls 18 and lower horizontal lateral H beams 48 extend internally of housing 12 along the lower edge of end walls 20 and 22.

Main frame members 38, 42, 44, 46 and 48 are interconnected by any appropriate means such as welding or riviting to form a rigid framework for supporting housing 12 and the electrode system 13.

So that a minimum of gas is allowed to bypass the electrode system 13, the electrostatic precipitator 10 may be provided with side baffles 15 and bottom baffles **17*a* and 17*b* which are fastened to housing 12 and main frame 36.**

The electrode system 13 includes a plurality of laterally spaced longitudinally extending vertical impervious metallic collector plate electrodes 60 rigidly connected to a longitudinally extending angle bar 61 the ends of which reset on the lower flange of each of H beams 44 whereby each plate or electrode 60 is independently supported. Each of bars 61 is connected to an electrode rapper 63A–63F for purposes of jarring or vibrating the individual collector plate electrode 60 for purposes of cleaning.

Disposed between each of pair of particles collector plate electrodes 60 is a discharge electrode 62 having a generally planar configuration. Each of electrodes 62 include a tubular metallic frame 64 which is traversed by a plurality of vertically extending metallic wires 66. Each frame 64 has a shoulder 68 at its upstream and downstream edges which rest upon and make electrical contact with a pair of conductor support channels 70. Support channels 70 are anchored to four vertically extending conductor rods 72 supported by and extend through insulators 74 which are supported on top wall 14. Thus an electrical path is provided from conductor rods 72, through channels 70, shoulders 68, frames 64 to wires 66 which are all insulated from the other portions of the precipitator whereby an electrical charge may be applied to the discharge electrodes 62 of substantially higher potential than collector electrodes 60 which for purposes of this disclosure may be maintained at ground level. Each of frames 64 is connected through an electrical insulating member to an electrode rapper 76A–76E for purposes of jarring or vibrating the individual discharge electrodes 62 for purposes of cleaning.

A straight vertical tube 80 closed at each end is disposed upstream of each collector plate electrode 62. Each tube 80 functions as a pneumatic flow repulsing means in opposition to the normal flow of primary gas passing through the collector assembly. Each tube 80 is spaced a uniform distance of about 7 to 15 centimeters upstream of the edge and laterally centered with respect to its associated plate electrode 62. Tubes 80 are rigidly fixed to and supported adjacent their upper and lower ends by a pair of angle bars 81 which are supported by the main frame 36. Each tube 80 is connected via a solenoid valve 82A–82F to a pneumatic supply manifold 3 for individually and selectively pressurizing each of tubes 80 from a pneumatic supply such as a blower or compressor (not shown) capable of delivering to each tube a steady pressure between 1200 and 5000 newtons per square meter. Each flow director tube 80 is provided with a pattern of outlet orifices or jets 83 which are arranged to direct the pneumatic fluid secondary gas at a velocity of between about 50 and 150 meters per second in counter momentum relationship with respect to the primary gas passing from inlet 26 to outlet 32 at a velocity of between about 1 and 5 meters per second so as to substantially arrest such flow over the surface of its associated collector plate electrode.

Figure 4:
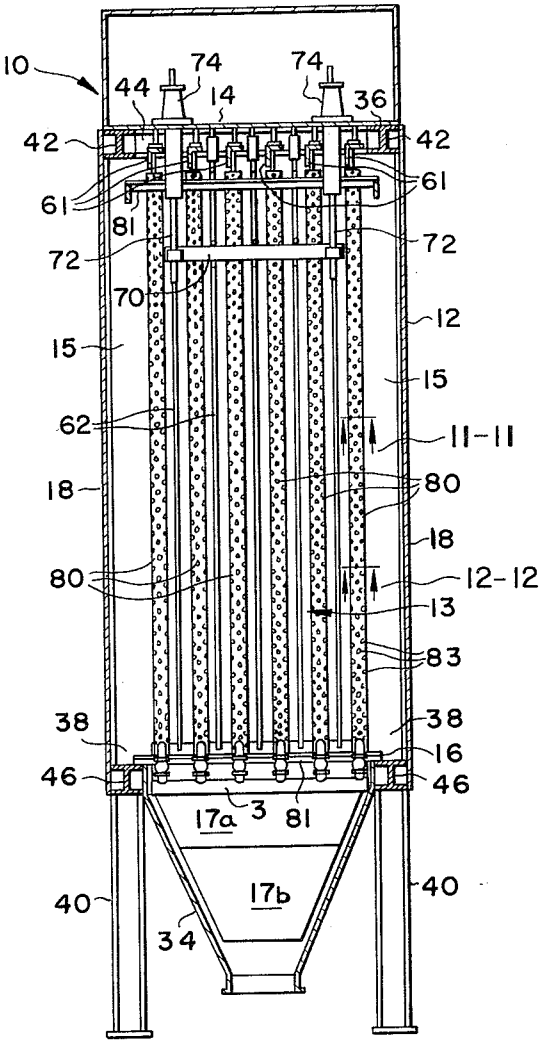
FIG. 4 is a lateral vertical section taken at lines 4—4 of FIG. 1.
Figure 3:
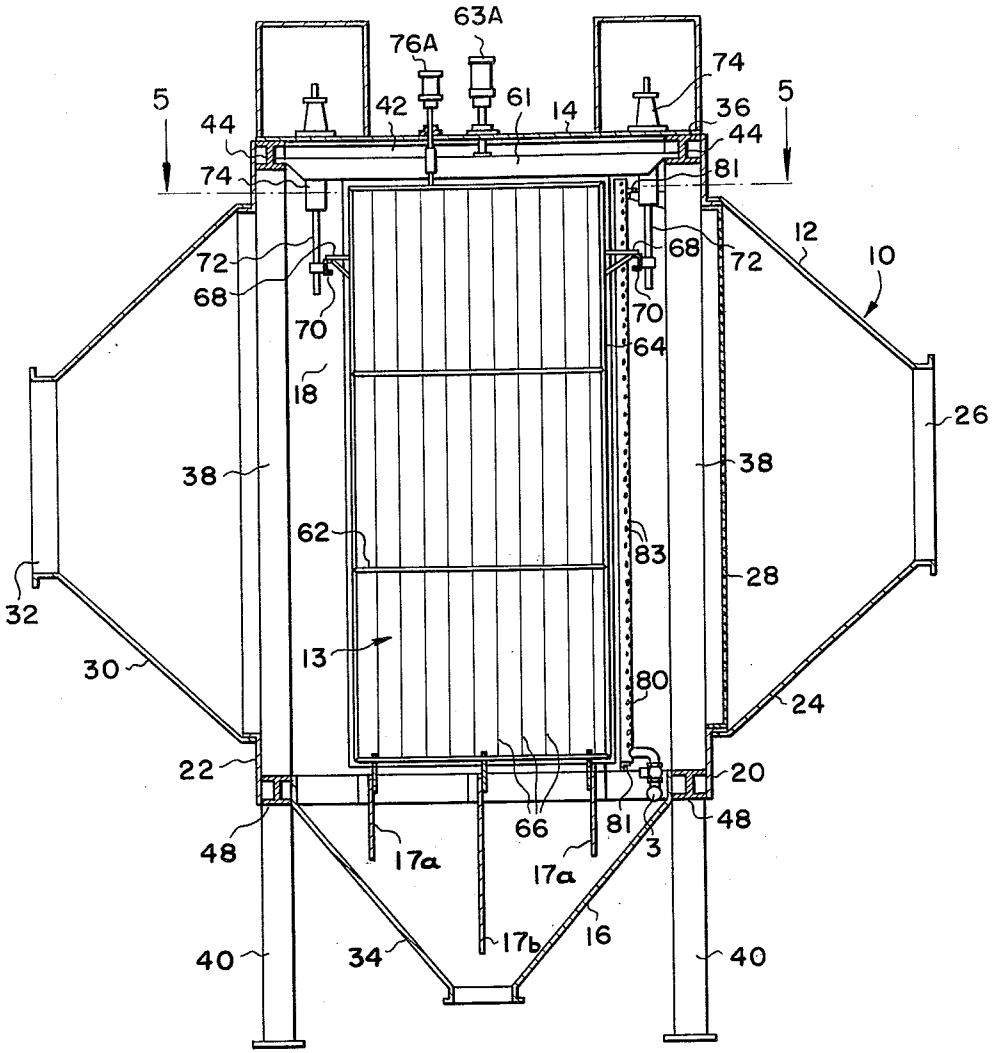
FIG. 3 is a longitudinal vertical section taken at line 3—3 of FIG. 2.
Figure 6:
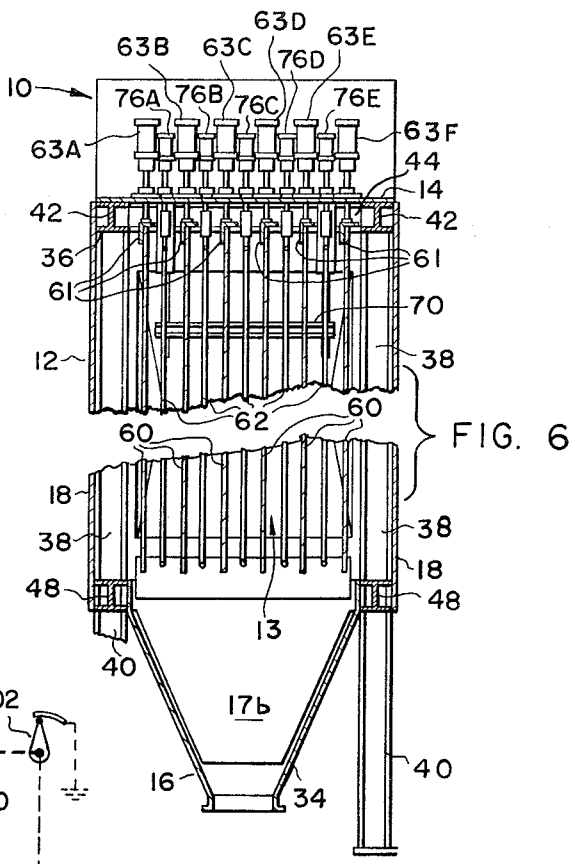
FIG. 6 is a vertical section taken at lines 6—6 of FIG. 1.
Figure 12:
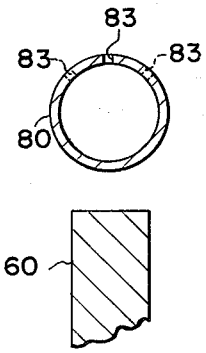
FIG. 12 is a horizontal section of a detail taken at line 12—12 in FIG. 4.
Figure 11:
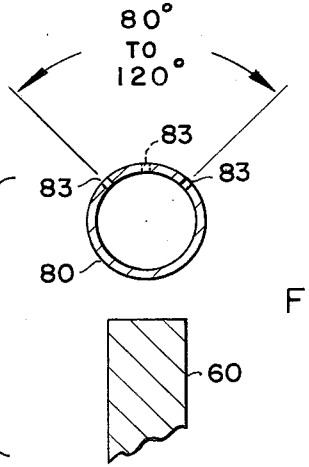
FIG. 11 is a horizontal section of a detail taken at line 11—11 in FIG. 4.

Each tube 80 has three rows of uniformly vertically spaced jets 83. Each row directs a stream of secondary gas. The outermost rows of jets diverge horizontally at an angle of between 80° and 120° as best seen in FIG. 11. The jets in these rows are at the same level. The jets of the center row are vertically intermediate to the jets of the outer rows as will be seen from FIGS. 4 and 12. In the modification shown in FIGS. 13–15 the same jet pattern is used on the flow director tubes disposed midway between the collector electrodes. Each aperture or orifice 83 may be provided with a nozzle fitting or simply consist of a drilled or punched hole.

Figure 10:
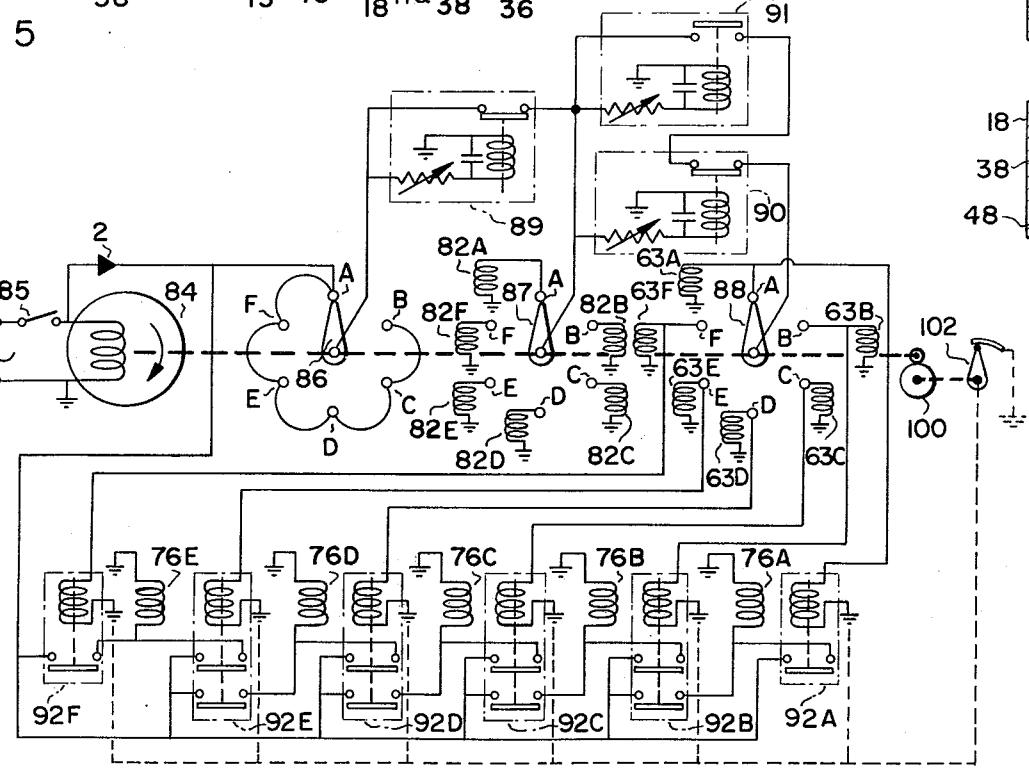
FIG. 10 is a control circuit for operating the precipitator apparatus of FIG. 1.
Figures 7, 8, 9:
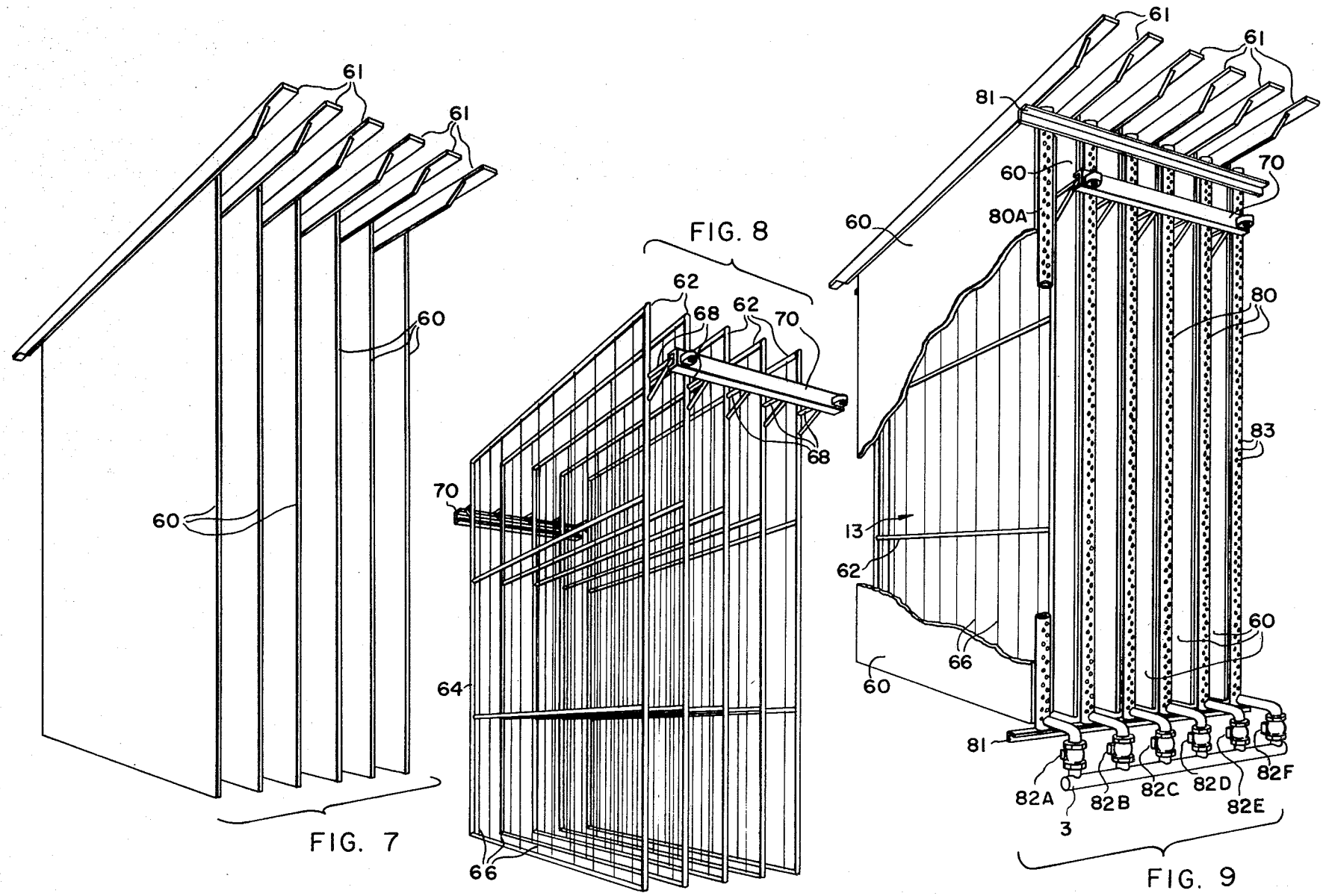
FIG. 7 is a perspective of collector plate electrodes used in the precipitator apparatus of FIG. 1.
FIG. 8 is a perspective of the discharge electrodes used in the precipitator apparatus of FIG. 1.
FIG. 9 is a perspective showing the flow blocking apparatus disposed in front of the collector plate and discharge electrodes of the precipitator of FIG. 1.

The operation of the electrostatic precipitator apparatus shown in FIGS. 1–12 may best be understood by reference to the exemplary schematic control shown in FIG. 10. To this end we have provided a sequencing motor 84 which upon closure of switch 85 rotates three distributor arms 86, 87, and 88 sequentially in contact with contacts A, B, C, D, E and F at a rate of about six revolutions per hour. When all the arms 86, 87 and 88 reach position A, a circuit is established from the power source 1 through a rectifier diode 2, contact A, distributor arm 86, normally closed contact of relay 89, distributor arm 87 to solenoid valve 82A. The energization of valve 82A allows high pressure secondary gas from manifold 3 to pass into tube 80A from whence it is directed by jets 83 of tube 80A to repulse the flow through the electrode system 13 in the vicinity of plate 60A. This flow blocking effect will continue for about 15 to 35 seconds until the RC time delay circuit associated with relay 89 causes the contacts of relay 89 to open.

During this 15 to 35 second period that the contacts of relay 89 are closed, a circuit is also made to relay 90. Because of the RC time delay circuit associated with relay 90 the normally closed contacts of relay 90 will remain closed for a period of 15–25 seconds. A third circuit is also energized during closure of the contacts of relay 89 through relay 91. However, the RC circuit associated with relay 91 is adjusted so that the normally open contacts of relay 91 will remain open for a period of about 10 to 15 seconds. It will thus be seen that about 10 to 15 seconds following the energization of valve 82A a circuit is completed from the power source, through the rectifier diode, distributor 86, through the contact of relay 89, through the contact of relay 91, through the contact of relay 90, through the distributor arm 88 to energize plate electrode rapper 63A whereby collector plate electrode 60A will be jarred for a period of about five seconds until the contacts of relay 90 open to de-energize the circuit. Solenoid valve 82A will remain energized during the rapping and for a 10 to 15 second period thereafter until the contacts of relay 89 open. Contacts of relay 89 will not again conduct current until the distributor arms have moved to position B when again the same cycle is initiated with respect to plate electrode 60B.

In the event it is considered desirable to rap the discharge electrodes, further circuits may be connected to the distributor arm 88. Thus while collector plate rapper 63A is energized, relay 92A will also be energized to complete a circuit through the normally open contacts of relay 92A and discharge electrode rapper 76A. Only one discharge rapper is involved because collector plate electrode 60A has a discharge electrode at only one side. However, when rapper 63B is energized for collector plate electrode 60B, relay 92B will be energized to complete circuits through both sets of normally open contacts to energize discharge electrode rappers 76A and 76B on each side of the collector plate electrode 60B.

The sequence will proceed in this manner through all positions A–F until after a period of about 10 minutes the entire sequence is once again initiated. It should be appreciated that the specific periods of flow repulsing and rapping and the mechanism for timing and rapping such as the use of pneumatic rappers and electronic controls are contemplated modifications.

Thus it may be desirable to rap the discharge electrode less frequently than the collector electrode. For example the discharge electrode might be rapped only one-tenth as often as the collector electrodes. This may be accomplished as follows. The output shaft of motor 84 may be lead to a speed reducer 100 having a speed ratio of 10 to 1. The output of the speed reducer is connected to a rotary switch 102. Switch 102 is constructed to be closed during only one-tenth of each revolution. Switch 102 is placed in series with the grounds of relay coils 92A–F as shown by the dashed lines. The discharge electrodes will thus be cleaned only once for every 10 cycles of collector cleaning. It will be understood that the rapping periods may be varied in frequency and duration for the collector and discharge electrodes to meet the requirements of individual situations.

Figure 5:
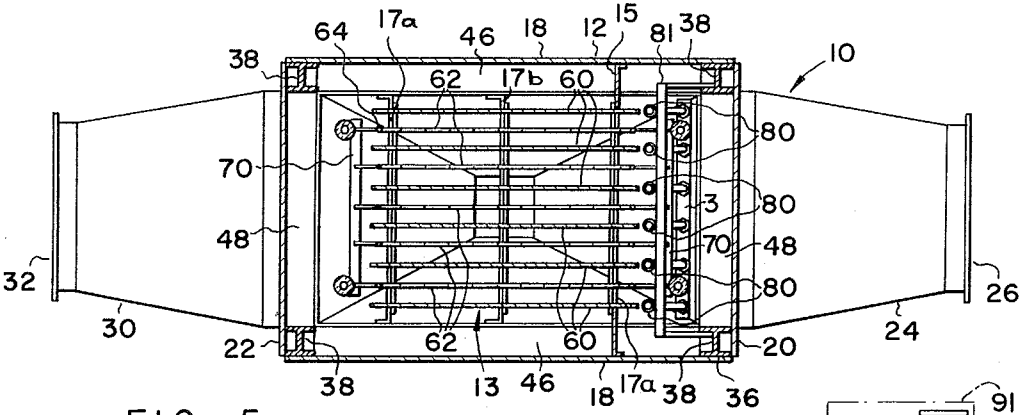
FIG. 5 is a horizontal section taken at lines 5—5 of FIG. 3.
Figure 14:
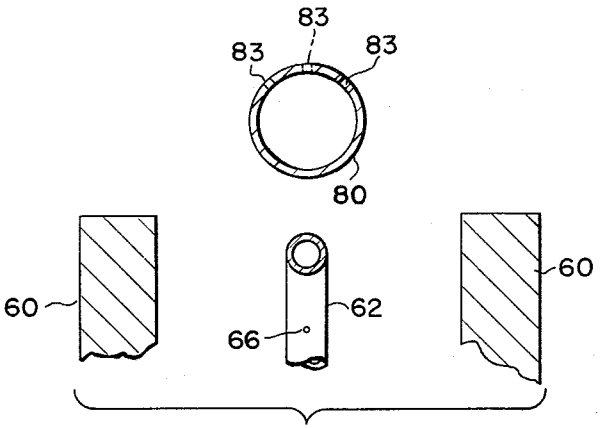
FIG. 14 is a view similar to FIG. 11 but of the modified form of the invention of FIG. 13.
Figure 15:
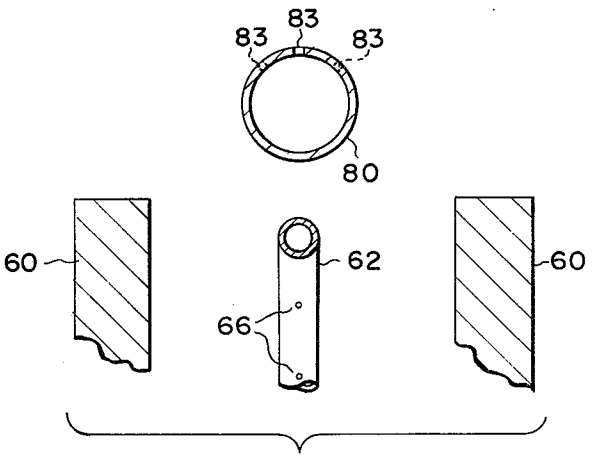
FIG. 15 is a view similar to FIG. 12 but of the modified form of the invention of FIG. 13.
Figure 13:
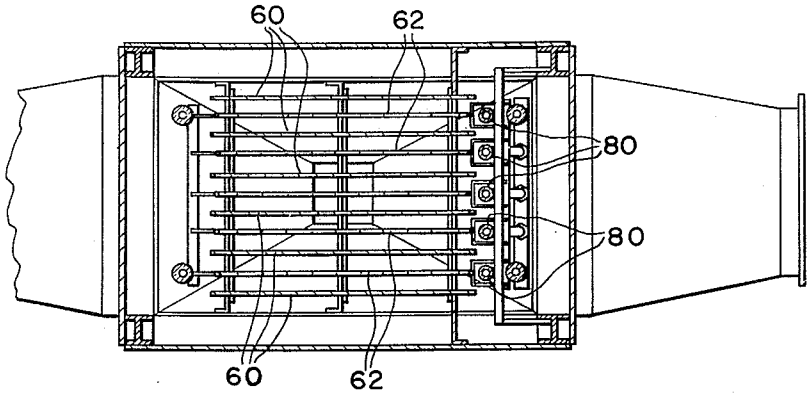
FIG. 13 is a view similar to FIG. 5 showing a modified form of the invention in which the pneumatic flow repulsing jets are disposed midway between the collector plate electrodes.

In the modifications of our invention drawn in FIG. 13–15, tubes 80, which correspond to tubes 80 of FIG. 5, have been positioned midway between adjacent collector electrodes 60 at their upstream edge. It will be apparent that should such a modification be made to the precipitator structure, small modifications must also be made to the controls so that the tubes 80 on each side of the collector electrode being rapped are pressurized so as to establish a quiescent zone on each side of the collector electrode being cleaned.

Further modifications may be made as to modular construction. Thus it is contemplated that the collector plates of the precipitator apparatus may be grouped with partitions separating the groups into modules. Thus the precipitator apparatus shown in FIGS. 1 and 2 of the drawing may be one module of several modules placed side-by-side in parallel relation in the fluid stream being cleaned. In such event it would be desirable to arrange the flow repulsing means to repulse the flow for the entire module. Thus the plates of one module would be jarred and the flow thereover stagnated while the adjacent collector plates of the adjacent modules continue in operation collecting dust.

Thus it will be seen that we contemplate that many changes may be made without departing from the scope or spirit of our invention and we accordingly desire to be limited only by the claims.

We claim:

1. Electrostatic precipitator apparatus for removing particles from a primary gas containing particles comprising: a plurality of pairs of spaced substantially impervious particle collector plate electrodes; means for imparting an electrostatic charge to said particles relative to said electrodes; means for passing streams of said primary gas containing particles into the spaces between said pairs of said electrodes from an upstream end toward a downstream end whereby the charged particles are attracted by and precipitated on said electrodes; means for jarring each of said electrodes for removing particles therefrom; pneumatic flow repulsing means disposed adjacent said upstream end of said electrodes and spaces for directing a stream of secondary gas in a direction having a predominant component opposing the flow of said primary gas and particles into the spaces to thereby substantially arrest the flow of said primary gas and particles into the spaces; and means for intermittently operating said jarring means associated with at least one of said electrodes but less than all of said electrodes and simultaneously operating said pneumatic flow repulsing means associated with at least one of said spaces adjacent said one electrode whereby a substantially quiescent condition within said space is produced by said secondary gas during removal of said particles from said one electrode by said jarring means to thereby reduce further particles dispersion within said space and re-entrainment of said removed particles in said primary gas at said downstream end of said space.

2. The apparatus as defined by claim 1 wherein said pneumatic flow repulsing means includes a perforated tube.

3. The apparatus as defined in claim 1 wherein said pneumatic flow repulsing means includes flow director means disposed substantially midway between the electrodes of one of said pair of electrodes for directing a secondary stream of said secondary gas in a direction having a substantial component parallel to said electrodes and opposite to the flow of said primary gas.

4. The apparatus as defined by claim 3 wherein said flow director means for directing a secondary stream includes a row of discrete jet orifices.

5. The apparatus as defined in claim 1 wherein said pneumatic flow repulsing means includes flow director means disposed substantially midway between the electrodes of a pair of electrodes for directing two diverging secondary streams of said secondary gas each in a direction having a substantial component parallel to said electrodes of said pair of electrodes and opposite to the flow of said primary gas.

6. The apparatus as defined by claim 5 wherein said flow director means for directing two diverging secondary streams includes at least one row of discrete jet orifices.

7. The apparatus as defined in claim 5 wherein said diverging secondary streams diverge at an included angle of between 80° and 120°.

8. The apparatus as defined in claim 1 wherein said pneumatic flow repulsing means includes flow director means disposed along the upstream edge of said one electrode for directing a secondary stream of said secondary gas in a direction having a substantial component parallel to said electrodes and opposite to the flow of said primary gas.

9. The apparatus as defined by claim 8 wherein said flow director means for directing said secondary streams includes a row of discrete jet orifices.

10. The apparatus as defined in claim 1 wherein said pneumatic flow repulsing means includes flow director means disposed along the upstream edge of said one electrode for directing two diverging secondary streams of secondary gas each having a direction having a substantial component parallel to said electrode and opposite to the flow of said primary gas.

11. The apparatus as defined by claim 10 where said flow director means for directing two diverging secondary streams includes a row of discrete jet orifices.

12. The apparatus as defined in claim 10 wherein said diverging secondary streams diverge at an included angle of between 80° and 120°.

13. The apparatus as defined by claim 10 wherein each of said secondary streams are directed by a row of discrete jet orifices.

14. Electrostatic precipitator apparatus for removing particles from a mixture of primary gas and particles comprising: a plurality of pairs of spaces substantially impervious substantially parallel particle collector plate electrodes; means for imparting an electrostatic charge to said particles relative to said electrodes; means for passing streams of said mixture of primary gas and particles at a velocity of between 1 and 5 meters per second into the spaces between said electrodes of said pairs of electrodes from an upstream end toward a downstream end in a direction having a substantial horizontal component whereby charged particles are attracted by and precipitated on said electrodes; means for jarring each of said electrodes for removing particles therefrom; means disposed adjacent said upstream end of said electrodes and spaces for directing a secondary gas at a velocity of between 50 and 150 meters per second in a direction having a substantial horizontal component opposing said flow of primary gas and particles into the spaces between said electrodes to thereby substantially arrest the flow of said primary gas and particles into the spaces between said electrodes; and means for intermittently simultaneously operating said jarring means associated with one of but less than all of said electrodes and said pneumatic flow repulsing means associated with at least one of said spaces adjacent said one electrode whereby that portion of the flow of primary gas and particles into said space is arrested by said secondary gas during intermittent removal of said particles from said one electrode to thereby reduce re-entrainment of said removed particles in said primary gas at said downstream end.

15. An electrostatic precipitator apparatus comprising a plurality of collector plate electrodes; means for passing a primary gaseous stream containing particles over said collector plate electrodes; means for applying an electrostatic charge to the particles within said primary gaseous stream relative to said collector plate electrodes whereby said particles are attracted to and deposited on said collector plate electrodes; means for periodically jarring said collector plate electrodes for a predetermined period for cleaning collected particles therefrom; a fluid conduit extending along the upstream edge of each of said collector plate electrodes; orifice means associated with said conduit for discharging a secondary gas from said conduit in a director so as to repulse the flow of primary gas over said collector plate electrodes; and means for periodically pressurizing said fluid conduits for a predetermined period; sa.. predetermined period for pressurizing the fluid conduit associated with one of said collector plate electrodes coincides with the predetermined period of jarring said one collector plate electrode.

16. The apparatus as defined by claim 15 wherein said period of pressurizing said fluid conduit extends beyond both ends of said period of jarring said one collector plate electrode.

17. The apparatus as defined by claim 16 wherein the period of pressurizing extends beyond the period of jarring at each end thereof for about 10 to 15 seconds.

18. An electrostatic precipitator apparatus comprising a plurality of collector plate electrodes; means for passing a primary gaseous stream containing particles over said collector plate electrodes; means for applying an electrostatic charge to the particles within said primary gaseous stream relative to said collector plate electrodes whereby said particles are attracted to and deposited on said collector plate electrodes; means for periodically jarring said collector plate electrodes for a predetermined period for cleaning collected particles therefrom; a fluid conduit operatively associated with said collector plate electrodes; orifice means associated with said conduit for discharging a secondary gas from said conduit in a direction so as to repulse the flow of primary gas over said collector plate electrodes; means for periodically pressurizing said fluid conduit for a predetermined period; said predetermined period for pressurizing the fluid conduit associated with one of said collector plate electrodes coinciding with the predetermined period of jarring said one collector plate electrode.

19. The apparatus as defined in claim 18 wherein said period of pressurizing said fluid conduit extends beyond both ends of said period of jarring said one collector plate electrode.

20. The apparatus as defined by claim 19 wherein the period of pressurizing extends beyond the period of jarring at each end thereof for about 10 to 15 seconds.

* * * * *